United States Patent [19]

Fukunaga et al.

[11] Patent Number: 4,660,960

[45] Date of Patent: Apr. 28, 1987

[54] IMAGING AGENT SUPPLY AND RECOVERY TANK OF ELECTRONIC IMAGING DEVICE

[75] Inventors: Takahiro Fukunaga, Nara; Shoichiro Yoshiura, Yamatokoriyama, both of Japan

[73] Assignee: Sharp Kabushiki Kaisha, Osaka, Japan

[21] Appl. No.: 746,763

[22] Filed: Jun. 20, 1985

[30] Foreign Application Priority Data

Jun. 22, 1984 [JP] Japan ..... 59-129868

[51] Int. Cl.[4] ..... G03G 15/06

[52] U.S. Cl. ..... 355/3 DD; 355/15; 222/DIG. 1; 220/403

[58] Field of Search ..... 355/3 DD, 3 R, 15; 222/DIG. 1, 130; 220/403, 20

[56] References Cited

U.S. PATENT DOCUMENTS

| | | | |
|---|---|---|---|
| 3,700,328 | 10/1972 | Davidge et al. | 355/3 DD |
| 3,752,576 | 8/1973 | Gerbasi | 355/3 DD |
| 4,323,306 | 4/1982 | Ito et al. | 355/3 DD |
| 4,357,097 | 11/1982 | Koiso | 355/3 DD |

*Primary Examiner*—R. L. Moses

*Attorney, Agent, or Firm*—Birch, Stewart, Kolasch & Birch

[57] ABSTRACT

An electronic imaging apparatus such as an electrophotographic copying machine comprises an image forming device for forming an image corresponding to the image of an original, an image agent supply for supplying an image agent to the image forming device, a developer for developing the image formed by the image forming device, and a recycle device for recycling the imaging agent which has not been used for the image forming process by the image forming device, the image agent supply being further responsive to the recycle device for receiving the recycled image agent gathered by the recycled device.

7 Claims, 3 Drawing Figures

IMAGING AGENT SUPPLY AND RECOVERY TANK OF ELECTRONIC IMAGING DEVICE

BACKGROUND OF THE INVENTION

The present invention relates to an electronic imaging apparatus including an electrophotographic copying machine and, more particularly, to a recovery system for an imaging agent such as toner particles for use in an electronic imaging appratus including an electrophotographic copying machine.

Conventionally, an electronic imaging apparatus including an electrophotographic copying machine is equipped with a type of recovery means for automatically recovering an imaging agent such as toner from a cleaning device to a specific recovery tank, so that an imaging agent supply tank and such a recycle recovery tank are separately and independently needed, thereby rendering a large imaging apparatus. Further, the conventional recovery tank should have a detector for detecting the amount of the recycled imaging agent contained to announce the necessity of replacement.

SUMMARY OF THE INVENTION

Accordingly, it is an object of the present invention to provide an improved electronic imaging apparatus comprising a single receptacle functioning as an imaging agent supply means and an imaging agent recovery receptacle.

It is another object of the present invention to provide an improved single tank functioning as a newly supplied agent container and a recycled-agent container, the recycled-agent container changing the inner space corresponding to the amount of the recycled agent.

Briefly described, in accordance with the present invention, an electronic imaging apparatus including an electrophotographic copying machine comprises image forming means for forming an image corresponding to the image of an original, agent supply means for supplying an image agent to the image forming means, developing means responsive to the image agent supply means for developing the image formed by the image forming means, and recycle means for recycling the image agent which has not been used for the image forming process by the image forming means, the agent supply means being further responsive to the recycle means for receiving the recycled image agent gathered by the recycle means.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

It should be noted that the application of the present invention is not be limited to an electrophotographic copying machine although the preferred embodiment of the present invention is explained hereinbelow in terms of such a copying machine.

Figure 1:
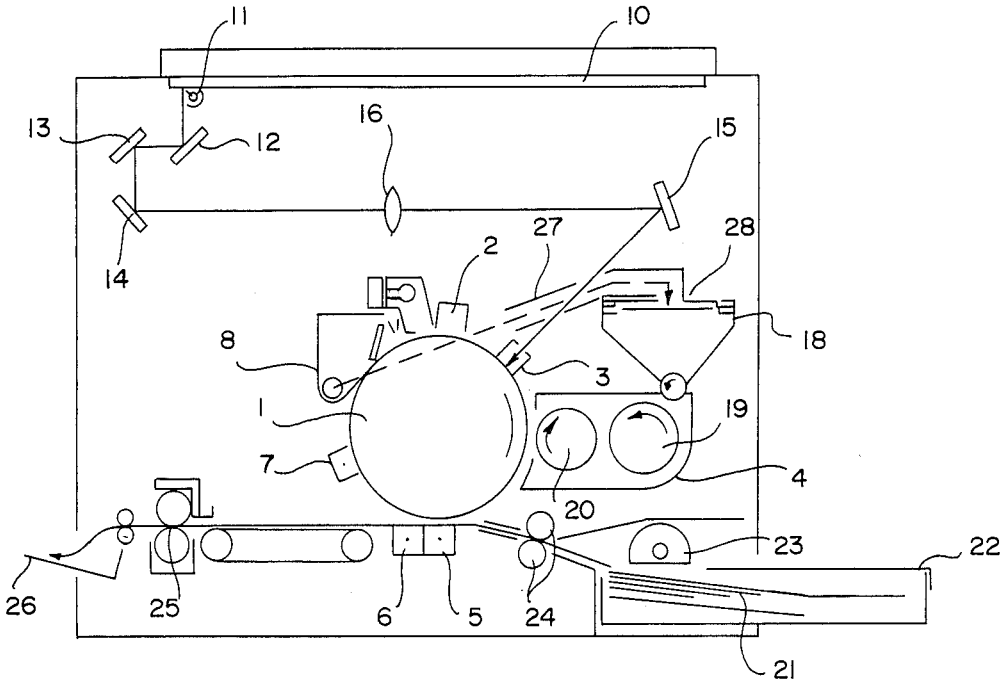
FIG. 1 is a sectional view of an electronic imaging apparatus such as an electrophotographic copying machine comprising an imaging agent recylce means according to the present invention.

FIG. 1 is a sectional view of an electrophotographic copying machine comprising an imaging agent recycle means according to the present invention.

A photoreceptor drum 1 is rotated around its axis clockwise in a constant speed. There are provided, around the photoreceptor drum 1, a charger 2, a light exposure device 3, a developing device 4, a corona transfer device 5, a paper separating charger 6, a charge removing device 7, an imaging agent cleaning device 8, and a charge removing lamp 9. A copy original is mounted on a document table 10. A copy lamp 11 is activated for emitting light toward the original. The reflected light from the original is incident upon the light exposure device 3 through mirrors 11, 12, 13, 14, 15, and a lens 16. The charger 2 is operated for causing corona discharge to generate ions and uniformly charge a photoconductive layer positioned at the surface of the photoreceptor drum 1. The light exposure device 3 is operated for passing the reflected light from the original toward the photoreceptor drum 1 with focusing. An electrostatic latent image is caused on the photoconductive layer of the photoreceptor drum 1, corresponding to the light image of the original.

An imaging agent supply cartridge 18 is operated for supplying an imaging agent such as toner into the developing device 4. A pair of electromagnet rollers 19 and 20 are operated for transferring the imaging agent toward the surface of the photoreceptor 1 to develop the toner image. A single copy paper 21 is picked-up from a paper supply cartridge 22 by a paper pick-up roller 23. A pair of rollers 24 are operated for overlapping the copy paper onto the surface of the photoreceptor drum 1 at the corona transfer device 5 with timing synchronization. The corona transfer device 5 is operated for charging the copy paper in a polarity opposed to that of the imaging agent from the rear side of the copy paper 21, so that the imaging agent is electrostatically transferred into the copy paper 21. The copied paper 21 is separated from the surface of the photoreceptor drum 1 by the charge removing device 6. In the transferring process, the charges of the copy paper 21 are removed by alternating corona discharge. A heating roller means 25 is operated for heating the copied paper 21 to fix the toner image on the copied paper 21. An exhaust tray 26 is provided for receiving the copied paper 21. To clean the imaging agent remaining on the surface of the photoreceptor drum 1 after the transferring process, the charge removing device 7 is operated for removing the charges from the photoreceptor drum 1. The cleaning device 8 is operated for removing the imaging agent and the charge removing lamp 9 is switched on.

According to the present invention, the imaging agent gathered by the cleaning device 8 is recycled into the imaging agent supply cartridge 18. For this purpose, a recycled imaging agent recovery pipe 27 is provided between the cleaning device 8 and the imaging agent supply cartridge 18. Within the pipe 27, a coiled spring is inserted, which is rotated for transferring the imaging agent. The recycled imaging agent is transferred at the upper position of the imaging agent supply cartridge 18, so that it is recovered into the cartridge 18 through a recovery inlet 28 at the upper position of the cartridge 18.

Figure 2:
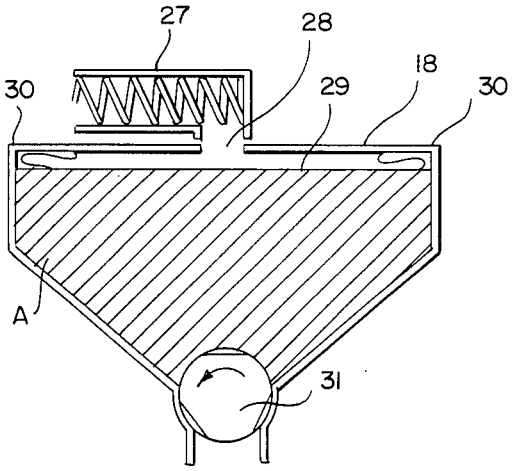
FIGS. 2 and 3 are sectional views of the imaging agent recycle means of the present invention, FIG. 3 showing the operation thereof.
Figure 3:
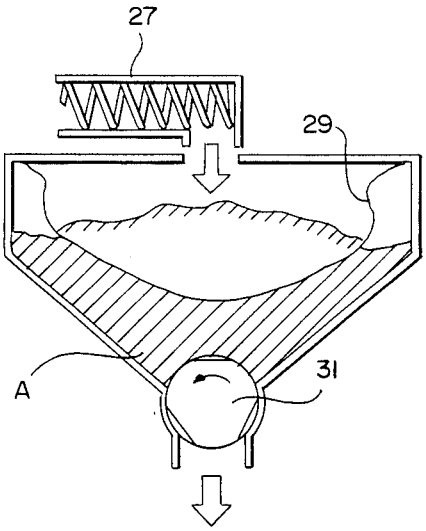

FIGS. 2 and 3 are sectional views of the cartridge 18.

With reference to FIG. 2, a separating sheet-like member 29 is provided for separating the space within the cartridge 18 into two compartments. The separating sheet-like member 29 is made of an elastic material such as vinyl resin. The edges of the separating member 29 are combined to an upper portion 30 of the cartridge 18. The member 29 is shaped like a case. When the cartridge 18 is filled with the imaging agent A to be newly supplied, the separating member 29 is made small because the recycled image agent is absent.

With reference to FIG. 3, a certain amount of the newly-supplied imaging agent is exhausted from the cartridge 18, so that the separating member 29 is expanded because a certain amount of the recycled agent is present. When an imaging agent supply means 31 is rotated for forwarding the agent A to the developing device 4, the volume of the agent A is gradually reduced and the upper face of the agent A is also lowered. The face of the separating member 29 is also lowered. The space positioned at the upper portion of the cartridge 18 is become larger. The recycled agent is put into this space through the recycle pipe 27. Thus, the single tank can function as the newly-supplied agent container and the recycled-agent container.

According to the arrangement of the present invention, the volume of the recycled agent is calculated to be the amount of the agent supplied from the tank minus the volume transferred onto the surface of the copy paper. Thus, the volume of the supplied agent equals or is greater than the volume of the recycled agent. This means that in the single agent tank, before the portion for containing the recycled agent is filled, the newly-supplied agent is empty. Here, the conventional level detector for detecting the level of the recycled agent container becomes unnecessary. When the old and supply agent-empty cartridge tank 18 is replaced by a new one, the recycled agent-purpose cartridge is also replaced. It can be prevented that the replacement of the old recyled-agent cartridge remains forgotten.

While only certain embodiments of the present invention have been described, it will be apparent to those skilled in the art that various changes and modifications may be made therein without departing from the spirit and scope of the present invention as claimed.

What is claimed is:

1. An electronic imaging apparatus comprising:

image forming means for forming an image corresponding to the image of an original;

means for supplying an imaging agent to said image forming means;

developing means, responsive to said means for supplying, for developing the image formed by said image forming means;

means for recycling the imaging agent which has not been used by said image forming means; and separating means having two sections, one of which is provided for containing a new imaging agent and the other of which is provided for receiving the recycled imaging agent.

2. The imaging apparatus of claim 1, wherein said imaging apparatus is an electrophotographic copying machine.

3. The imaging apparatus of claim 1, wherein said separating means is composed of an elastic material.

4. The imaging apparatus of claim 1, further comprising means for delivering the recycled imaging agent to said means for supplying.

5. An electronic imaging apparatus, comprising:

image forming means for forming an image corresponding to the image of an original;

holding means for temporarily storing an imaging agent for use with said image forming means;

means for supplying the imaging agent to said image forming means from said holding means;

developing means, responsive to said means for supplying, for developing the image formed by said image forming means;

means for recycling the imaging agent which has not been used by said image forming means; and means for receiving the recycled imaging agent in said holding means, wherein the imaging agent and the recycled imaging agent are separated from each other.

6. The imaging apparatus of claim 5, further including means for supplying the recycled imaging agent to said image forming means.

7. The imaging apparatus of claim 5, wherein said imaging apparatus is an electrophotographic copying machine.

* * * * *